US008356664B2

(12) United States Patent
Yeh et al.

(10) Patent No.: US 8,356,664 B2
(45) Date of Patent: Jan. 22, 2013

(54) WELLBORE METHOD AND APPARATUS FOR COMPLETION, PRODUCTION AND INJECTION

(75) Inventors: Charles S. Yeh, Spring, TX (US); David C. Haeberle, Cypress, TX (US); Michael D. Barry, The Woodlands, TX (US); Michael T. Hecker, Tomball, TX (US); Jon Blacklock, Katy, TX (US); Ted A. Long, Sugar Land, TX (US); Hans Brekken, Algard (NO); Arthur H. Dybevik, Sandnes (NO); Lars Faret, Sandnes (NO); Ole Sveinung Kvernstuen, Sandnes (NO); Terje Moen, Sandnes (NO); Knut H. Nesland, Algard (NO); Kjartan Roaldsnes, Kvernaland (NO)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 13/452,267

(22) Filed: Apr. 20, 2012

(65) Prior Publication Data

US 2012/0199342 A1 Aug. 9, 2012

Related U.S. Application Data

(62) Division of application No. 13/025,313, filed on Feb. 11, 2011, now Pat. No. 8,186,429, which is a division of application No. 11/983,447, filed on Nov. 9, 2007, now Pat. No. 7,938,184.

(60) Provisional application No. 60/859,229, filed on Nov. 15, 2006.

(51) Int. Cl.
*E21B 43/04* (2006.01)

(52) U.S. Cl. ..... 166/222; 166/51; 166/169; 166/278

(58) Field of Classification Search ..... 166/278, 166/51, 169, 222, 242.1
See application file for complete search history.

(56) References Cited

U.S. PATENT DOCUMENTS 2,018,283 A 10/1935 Schweitzer et al.
2,443,944 A 6/1948 Bean (Continued)

FOREIGN PATENT DOCUMENTS

EP 1 160 417 A2 12/2001

(Continued)

OTHER PUBLICATIONS

European Search Report No. 115377, dated Jul. 10, 2007, 4 pages.

(Continued)

*Primary Examiner* — Jennifer H Gay
(74) *Attorney, Agent, or Firm* — ExxonMobal Upstream Research Company—Law Department

(57) ABSTRACT

Apparatus associated with the production of hydrocarbons comprising a joint assembly comprising a main body portion having primary and secondary fluid flow paths, wherein the main body portion is attached to a load sleeve assembly at one end and a torque sleeve assembly at the opposite end. The load sleeve may include at least one transport conduit and at least one packing conduit. The main body portion may include a sand control device, a packer, or other well tool for use in a downhole environment. Included is a coupling assembly having a manifold region in fluid flow communication with the second fluid flow path of the main body portion and facilitating the make-up of first and second joint assemblies with a single connection.

6 Claims, 8 Drawing Sheets

U.S. PATENT DOCUMENTS 3,638,970 A 2/1972 Sandquist et al.
3,826,134 A 7/1974 Miller
3,827,728 A 8/1974 Hynes
4,018,275 A 4/1977 Gaut
4,510,996 A 4/1985 Hardin
4,945,991 A 8/1990 Jones
5,082,052 A 1/1992 Jones et al.
5,113,935 A 5/1992 Jones et al.
5,333,688 A * 8/1994 Jones et al. ..... 166/278
5,375,662 A 12/1994 Echols, III et al.
5,396,954 A 3/1995 Brooks
5,413,180 A 5/1995 Ross et al.
5,476,143 A 12/1995 Sparlin et al.
5,515,915 A 5/1996 Jones et al.
5,588,487 A 12/1996 Bryant
5,829,520 A 11/1998 Johnson
5,842,516 A 12/1998 Jones
5,868,200 A * 2/1999 Bryant et al. ..... 166/51
5,890,533 A 4/1999 Jones
5,934,376 A 8/1999 Nguyen et al.
6,059,032 A 5/2000 Jones
6,227,303 B1 5/2001 Jones
6,298,916 B1 * 10/2001 Tibbles et al. ..... 166/278
6,405,800 B1 6/2002 Walker et al.
6,409,219 B1 6/2002 Broome et al.
6,464,261 B1 10/2002 Dybevik et al.
6,481,494 B1 * 11/2002 Dusterhoft et al. ..... 166/51
6,505,682 B2 1/2003 Brockman
6,513,599 B1 2/2003 Bixenman et al.
6,516,881 B2 * 2/2003 Hailey, Jr. ..... 166/278
6,516,882 B2 2/2003 McGregor et al.
6,557,634 B2 5/2003 Hailey, Jr. et al.
6,575,251 B2 6/2003 Watson et al.
6,581,689 B2 * 6/2003 Hailey, Jr. ..... 166/278
6,588,506 B2 * 7/2003 Jones ..... 166/278
6,666,274 B2 12/2003 Hughes
6,695,067 B2 2/2004 Johnson et al.
6,749,023 B2 6/2004 Nguyen et al.
6,749,024 B2 6/2004 Bixenman
6,752,207 B2 6/2004 Danos et al.
6,755,245 B2 6/2004 Nguyen et al.
6,789,624 B2 9/2004 McGregor et al.
6,814,139 B2 11/2004 Hejl et al.
6,814,144 B2 11/2004 Jones
6,817,410 B2 * 11/2004 Wetzel et al. ..... 166/233
6,843,480 B2 * 1/2005 Nelson et al. ..... 277/338
6,883,608 B2 4/2005 Parlar et al.
6,923,262 B2 8/2005 Broome et al.
6,983,796 B2 1/2006 Bayne et al.
6,986,390 B2 1/2006 Doane et al.
7,048,061 B2 5/2006 Bode et al.
7,100,691 B2 9/2006 Nguyen et al.
7,104,324 B2 9/2006 Wetzel et al.
7,147,054 B2 12/2006 Wang et al.
7,152,677 B2 12/2006 Parlar et al.
7,207,383 B2 4/2007 Hurst et al.
7,222,676 B2 * 5/2007 Patel et al. ..... 166/378
7,243,715 B2 7/2007 Wang et al.
7,243,723 B2 7/2007 Surjaatmadja et al.
7,243,724 B2 7/2007 McGregor et al.
7,243,732 B2 7/2007 Richard
7,264,061 B2 9/2007 Dybevik et al.
7,278,479 B2 10/2007 Kvernstuen et al.
7,343,983 B2 * 3/2008 Livingstone ..... 175/57
7,363,974 B2 4/2008 Wang et al.
7,370,700 B2 5/2008 Hurst et al.
7,373,978 B2 5/2008 Barry et al.
7,407,007 B2 8/2008 Tibbles
7,426,962 B2 9/2008 Moen et al.
7,431,058 B2 10/2008 Holting
7,431,085 B2 10/2008 Coronado et al.
7,441,605 B2 10/2008 Coronado et al.
7,464,752 B2 * 12/2008 Dale et al. ..... 166/227
7,493,959 B2 2/2009 Johnson et al.
7,562,709 B2 7/2009 Saebi et al.
7,584,799 B2 9/2009 Coronado et al.
7,591,321 B2 9/2009 Whitsitt et al.
7,597,141 B2 10/2009 Rouse et al.
7,661,476 B2 * 2/2010 Yeh et al. ..... 166/278
2002/0007948 A1 * 1/2002 Bayne et al. ..... 166/278
2002/0174984 A1 11/2002 Jones
2003/0000699 A1 * 1/2003 Hailey, Jr. ..... 166/278
2003/0000700 A1 * 1/2003 Hailey, Jr. ..... 166/278
2003/0173075 A1 9/2003 Morvant et al.
2004/0003922 A1 1/2004 Bayne et al.
2004/0074641 A1 4/2004 Hejl et al.
2004/0140089 A1 * 7/2004 Gunneroed ..... 166/228
2005/0028977 A1 * 2/2005 Ward ..... 166/278
2005/0061501 A1 * 3/2005 Ward et al. ..... 166/278
2005/0082060 A1 * 4/2005 Ward et al. ..... 166/278
2005/0103527 A1 * 5/2005 Church et al. ..... 175/62
2005/0205269 A1 9/2005 Kilgore et al.
2005/0284637 A1 12/2005 Stegent et al.
2005/0284643 A1 12/2005 Setterberg, Jr.
2007/0068675 A1 * 3/2007 Barry et al. ..... 166/278
2008/0128129 A1 * 6/2008 Yeh et al. ..... 166/275
2008/0142227 A1 * 6/2008 Yeh et al. ..... 166/369
2009/0008092 A1 * 1/2009 Haeberle et al. ..... 166/278
2009/0283279 A1 11/2009 Patel et al.
2009/0294128 A1 * 12/2009 Dale et al. ..... 166/306
2010/0032158 A1 * 2/2010 Dale et al. ..... 166/278
2010/0065284 A1 3/2010 Freyer
2010/0139919 A1 * 6/2010 Yeh et al. ..... 166/278
2010/0236779 A1 * 9/2010 Nutley et al. ..... 166/278
2011/0162840 A1 * 7/2011 Haeberle et al. ..... 166/278

FOREIGN PATENT DOCUMENTS

RU 2 160 360 C2 12/2000

OTHER PUBLICATIONS

Hurst, G. et al., "Alternate Path Completions: A Critical Review and Lessons Learned From Case Histories With Recommended Practices for Deepwater Applications", SPE 86532, SPE International Symposium and Exhibition on Formation Damage Control, Feb. 18-20, 2004, pp. 1-14, Lafayette, LA.

* cited by examiner

I-I

WELLBORE METHOD AND APPARATUS FOR COMPLETION, PRODUCTION AND INJECTION

CROSS REFERENCE TO RELATED APPLICATIONS

This application is a divisional of U.S. application Ser. No. 13/025,313, filed Feb. 11, 2011, which issued as U.S. Pat. No. 8,186,429 on May 29, 2012, which is a divisional of U.S. application Ser. No. 11/983,447, filed Nov. 9, 2007, which issued as U.S. Pat. No. 7,938,184 on May 10, 2011, all of which claim benefit of U.S. Provisional Application No. 60/859,229, filed Nov. 15, 2006.

This application contains subject matter related to U.S. patent application Ser. No. 11/983,445, filed Nov. 9, 2007, entitled "Gravel Packing Methods", which issued as U.S. Pat. No. 7,661,476 on Feb. 16, 2010. This application is commonly owned and shares at least one common inventor.

FIELD OF THE INVENTION

This invention relates generally to an apparatus and method for use in wellbores and associated with the production of hydrocarbons. More particularly, this invention relates to a joint assembly and related system and method for coupling joint assemblies including wellbore tools.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

The production of hydrocarbons, such as oil and gas, has been performed for numerous years. To produce these hydrocarbons, a production system may utilize various devices, such as sand screens and other tools, for specific tasks within a well. Typically, these devices are placed into a wellbore completed in either a cased-hole or open-hole completion. In cased-hole completions, a casing string is placed in the wellbore and perforations are made through the casing string into subterranean formations to provide a flow path for formation fluids, such as hydrocarbons, into the wellbore. Alternatively, in open-hole completions, a production string is positioned inside the wellbore without a casing string. The formation fluids flow through the annulus between the subsurface formation and the production string to enter the production string.

However, when producing hydrocarbons from some subterranean formations, it becomes more challenging because of the location of certain subterranean formations. For example, some subterranean formations are located in ultra-deep water, at depths that extend the reach of drilling operations, in high pressure/temperature reservoirs, in long intervals, in formations with high production rates, and at remote locations. As such, the location of the subterranean formation may present problems that increase the individual well cost dramatically. That is, the cost of accessing the subterranean formation may result in fewer wells being completed for an economical field development. Further, loss of sand control may result in sand production at surface, downhole equipment damage, reduced well productivity and/or loss of the well. Accordingly, well reliability and longevity become design considerations to avoid undesired production loss and expensive intervention or workovers for these wells.

Typically, sand control devices are utilized within a well to manage the production of solid material, such as sand. The sand control device may have slotted openings or may be wrapped by a screen. As an example, when producing formation fluids from subterranean formations located in deep water, it is possible to produce solid material along with the formation fluids because the formations are poorly consolidated or the formations are weakened by downhole stress due to wellbore excavation and formation fluid withdrawal. Accordingly, sand control devices, which are usually installed downhole across these formations to retain solid material, allow formation fluids to be produced without the solid materials above a certain size.

However, under the harsh environment in a wellbore, sand control devices are susceptible to damage due to high stress, erosion, plugging, compaction/subsidence, etc. As a result, sand control devices are generally utilized with other methods to manage the production of sand from the subterranean formation.

One of the most commonly used methods to control sand is a gravel pack. Gravel packing a well involves placing gravel or other particulate matter around a sand control device coupled to the production string. For instance, in an open-hole completion, a gravel pack is typically positioned between the wall of the wellbore and a sand screen that surrounds a perforated base pipe. Alternatively, in a cased-hole completion, a gravel pack is positioned between a perforated casing string and a sand screen that surrounds a perforated base pipe. Regardless of the completion type, formation fluids flow from the subterranean formation into the production string through the gravel pack and sand control device.

During gravel packing operations, inadvertent loss of a carrier fluid may form sand bridges within the interval to be gravel packed. For example, in a thick or inclined production interval, a poor distribution of gravel (i.e. incomplete packing of the interval resulting in voids in the gravel pack) may occur with a premature loss of liquid from the gravel slurry into the formation. This fluid loss may cause sand bridges to form in the annulus before the gravel pack has been completed. To address this problem, alternate flowpaths, such as shunt tubes, may be utilized to bypass sand bridges and distribute the gravel evenly through the intervals. For further details of such alternate flowpaths, see U.S. Pat. Nos. 4,945,991; 5,082,052; 5,113,935; 5,333,688; 5,515,915; 5,868,200; 5,890,533; 6,059,032; 6,588,506; and 7,464,752; which are incorporated herein by reference.

While the shunt tubes assist in forming the gravel pack, the use of shunt tubes may limit the methods of providing zonal isolation with gravel packs because the shunt tubes complicate the use of a packer in connection with sand control devices. For example, such an assembly requires that the flow path of the shunt tubes be un-interrupted when engaging a packer. If the shunt tubes are disposed exterior to the packer, they may be damaged when the packer expands or they may interfere with the proper operation of the packer. Shunt tubes in eccentric alignment with the well tool may require the packer to be in eccentric alignment, which makes the overall diameter of the well tool larger and non-uniform. Existing designs utilize a union type connection, a timed connection to align the multiple tubes, a jumper shunt tube connection between joint assemblies, or a cylindrical cover plate over the connection. These connections are expensive, time-consuming, and/or difficult to handle on the rig floor while making up and installing the production tubing string.

Concentric alternate flow paths utilizing smaller-diameter, round shunt tubes are preferable, but create other design difficulties. Concentric shunt tube designs are complicated by the need for highly precise alignment of the internal shunt tubes and the basepipe of the packer with the shunt tubes and basepipe of the sand control devices. If the shunt tubes are disposed external to the sand screen, the tubes are exposed to the harsh wellbore environment and are likely to be damaged during installation or operation. The high precision requirements to align the shunt tubes make manufacture and assembly of the well tools more costly and time consuming. Some devices have been developed to simplify this make-up, but are generally not effective.

Some examples of internal shunt devices are the subject of U.S. Patent Application Publication Nos. 2005/0082060, 2005/0061501, 2005/0028977, and 2004/0140089. These patent applications generally describe sand control devices having shunt tubes disposed between a basepipe and a sand screen, wherein the shunt tubes are in direct fluid communication with a crossover tool for distributing a gravel pack. They describe the use of a manifold region above the make-up connection and nozzles spaced intermittently along the shunt tubes. However, these devices are not effective for completions longer than about 3,500 feet.

Accordingly, the need exists for a method and apparatus that provides alternate flow paths for a variety of well tools, including, but not limited to sand control devices, sand screens, and packers to gravel pack different intervals within a well, and a system and method for efficiently coupling the well tools.

Other related material may be found in at least U.S. Pat. No. 5,476,143; U.S. Pat. No. 5,588,487; U.S. Pat. No. 5,934,376; U.S. Pat. No. 6,227,303; U.S. Pat. No. 6,298,916; U.S. Pat. No. 6,464,261; U.S. Pat. No. 6,516,882; U.S. Pat. No. 6,588,506; U.S. Pat. No. 6,749,023; U.S. Pat. No. 6,752,207; U.S. Pat. No. 6,789,624; U.S. Pat. No. 6,814,139; U.S. Pat. No. 6,817,410; U.S. Patent Application Publication No. 2004/0140089; U.S. Patent Application Publication No. 2004/0003922; U.S. Patent Application Publication No. 2005/0284643; U.S. Patent Application Publication No. 2005/0205269; and "Alternate Path Completions: A Critical Review and Lessons Learned From Case Histories With Recommended Practices for Deepwater Applications," G. Hurst, et al. SPE Paper No. 86532-MS.

SUMMARY

In one embodiment an apparatus associated with the drilling, production or monitoring of downhole environments is described. The apparatus includes a joint assembly comprising a main body portion having a first and second end and a load sleeve assembly having an inner diameter. The load sleeve assembly is operably attached to the main body portion at or near the first end, the load sleeve assembly including at least one transport conduit and at least one packing conduit, wherein both the at least one transport conduit and the at least one packing conduit are disposed exterior to the inner diameter. The apparatus further includes a torque sleeve assembly with an inner diameter and operably attached to the main body portion at or near the second end. The torque sleeve assembly also includes at least one conduit, wherein the at least one conduit is disposed exterior to the inner diameter. The apparatus further includes a coupling assembly operably attached to at least a portion of the first end of the main body portion, the coupling assembly including a manifold region, wherein the manifold region is configured to be in fluid flow communication with the at least one transport conduit and at least one packing conduit of the load sleeve assembly. The apparatus may also include a coax sleeve and at least one torque spacer as part of the coupling assembly.

Another embodiment describes an apparatus for use with drilling, production or monitoring of downhole environments including a coupling assembly comprising a first well tool having first and second ends, a first primary fluid flow path, and a first alternative fluid flow path. The apparatus also includes a second well tool having a first and second ends, a second primary fluid flow path, and a second alternative fluid flow path as well as a coupling, the coupling being operably attached to the first end of the first well tool and the second end of the second well tool, wherein the coupling allows for substantial axial alignment between the first primary fluid flow path and the second primary fluid flow path. The coupling assembly also includes a manifold region disposed substantially concentrically around the coupling, wherein the manifold region allows for substantial fluid flow communication between the first alternative fluid flow path and the second alternative fluid flow path and including at least one torque spacer operably attached to the coupling, wherein the torque spacer is substantially disposed within the manifold region. The coupling assembly may also include a coax sleeve around the coupling for enclosing the manifold region and attaching to at least one of the torque spacers.

Another embodiment of the apparatus describes a load sleeve assembly comprising an elongated body of substantially cylindrical shape having an outer diameter, a first and second end, and a bore extending from the first end to the second end, wherein the bore forms an inner diameter in the elongated body. The load sleeve assembly also includes at least one transport conduit and at least one packing conduit, each of the transport conduits and packing conduits extending from the first end to the second end of the elongated body, each of the transport conduits and packing conduits forming openings at each of the first end and second end of the elongated body, wherein the openings are located at least substantially between the inner diameter and the outer diameter. Further, the opening of the transport conduit is configured at the first end to reduce entry pressure loss. The load sleeve assembly may also include a shoulder portion configured to support a load, such as a load caused by production tube running operations.

Yet another embodiment of the apparatus describes a torque sleeve assembly comprising an elongated body of substantially cylindrical shape having an outer diameter, a first and second end, and a bore extending from the first end to the second end, the bore forming an inner diameter in the elongated body. The torque sleeve assembly also includes at least one transport conduit and at least one packing conduit located at least substantially between the inner and outer diameters of the elongated body, the transport conduit extending through the torque sleeve assembly from the first end to the second end, and the packing conduit extending from the first end to a position inside the torque sleeve assembly at an axial distance from the second end towards the first end of the elongated body where it may be in fluid flow communication with an exit nozzle.

A further embodiment of the apparatus describes a nozzle ring comprising a body of substantially cylindrical shape having an outer diameter and a bore extending from a first to a second end, the bore forming an inner diameter. The nozzle ring also including at least one transport channel and at least one packing channel, the at least one transport channel and at least one packing channel extending from the first to the second end and located substantially between the inner diameter and outer diameter, wherein each of the transport channel and packing channel are configured to receive a shunt tube therein. There may also be a hole formed in the outer diameter of the body and extending radially inward, wherein the hole at least partially intersects at least one of the at least one packing channel such that the at least one packing channel and the hole are in fluid flow communication. Further, at least one outlet formed from the at least one packing channel to the outer diameter.

A method of assembling the joint assembly is also described. The method includes operably attaching a load sleeve assembly to a main body portion at or near a first end of the main body portion, wherein the load sleeve assembly has an inner diameter and including at least one transport conduit and at least one packing conduit, wherein both the at least one transport conduit and the at least one packing conduit are disposed exterior to the inner diameter. The method also includes operably attaching a torque sleeve assembly to the main body portion at or near a second end of the main body portion, the torque sleeve assembly having an inner diameter and including at least one conduit, wherein the at least one conduit is disposed exterior to the inner diameter. Assembly further includes operably attaching a coupling to the first end of the main body portion and operably attaching at least one torque spacer to the coupling.

A method of producing hydrocarbons from a subterranean formation is also described, which includes producing hydrocarbons from the subterranean formation through a wellbore completed through at least a portion of the subterranean formation. The wellbore has a production string, the production string including a plurality of joint assemblies, wherein the plurality of joint assemblies comprise a load sleeve assembly having an inner diameter, at least one transport conduit and at least one packing conduit, wherein both the at least one transport conduit and the at least one packing conduit are disposed exterior to the inner diameter, the load sleeve operably attached to a main body portion of one of the plurality of joint assemblies. The plurality of joint assemblies also include a torque sleeve assembly having an inner diameter and at least one conduit, wherein the at least one conduit is disposed exterior to the inner diameter, and the torque sleeve is operably attached to a main body portion of one of the plurality of joint assemblies. Additionally, the joint assemblies include a coupling assembly having a manifold region, wherein the manifold region is configured be in fluid flow communication with the at least one transport conduit and at least one packing conduit of the load sleeve assembly, wherein the coupling assembly is operably attached to at least a portion of one of the plurality of joint assemblies at or near the load sleeve assembly.

BRIEF DESCRIPTION OF THE DRAWINGS

The foregoing and other advantages of the present techniques may become apparent upon reviewing the following detailed description and drawings in which.

DETAILED DESCRIPTION

Figure 1:
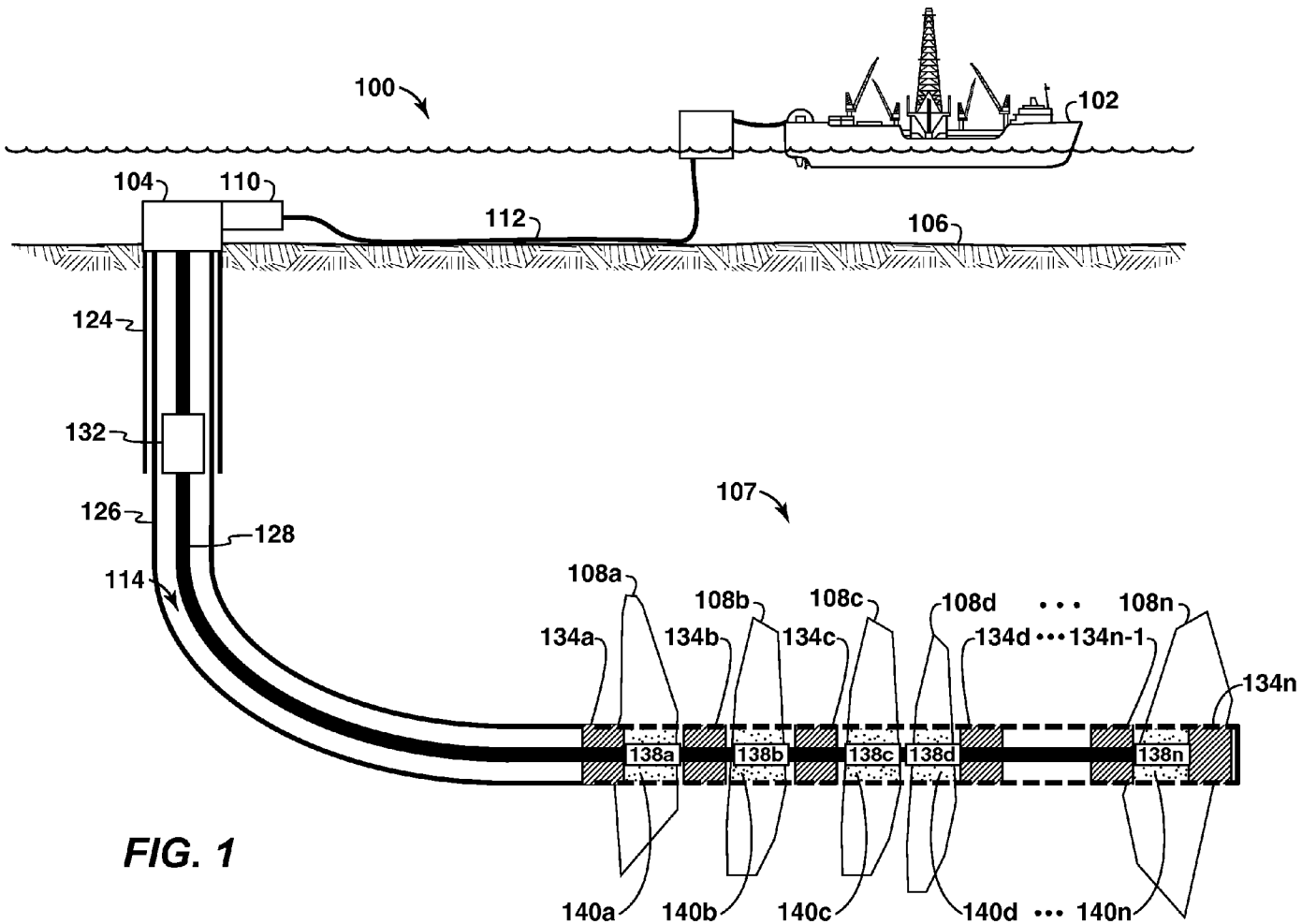
FIG. 1 is an exemplary production system in accordance with certain aspects of the present techniques.

In the following detailed description section, the specific embodiments of the present techniques are described in connection with preferred embodiments. However, to the extent that the following description is specific to a particular embodiment or a particular use of the present techniques, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

Although the wellbore is depicted as a vertical wellbore, it should be noted that the present techniques are intended to work in a vertical, horizontal, deviated, or other type of wellbore. Also, any directional description such as 'upstream,' 'downstream,' 'axial,' 'radial,' etc. should be read in context and is not intended to limit the orientation of the wellbore, joint assembly, or any other part of the present techniques.

Some embodiments of the present techniques may include one or more joint assemblies that may be utilized in a completion, production, or injection system to enhance well completion, e.g., gravel pack, and/or enhance production of hydrocarbons from a well and/or enhance the injection of fluids or gases into the well. Some embodiments of the joint assemblies may include well tools such as sand control devices, packers, cross-over tools, sliding sleeves, shunted blanks, or other devices known in the art. Under some embodiments of the present techniques, the joint assemblies may include alternate path mechanisms for utilization in providing zonal isolation within a gravel pack in a well. In addition, well apparatuses are described that may be utilized in an open or cased-hole completion. Some embodiments of the joint assembly of the present techniques may include a common manifold or manifold region providing fluid communication through a coupling assembly to a joint assembly, which may include a basepipe, shunt tubes, packers, sand control devices, intelligent well devices, cross-coupling flow devices, in-flow control devices, and other tools. As such, some embodiments of the present techniques may be used for design and manufacture of well tools, well completions for flow control, monitoring and management of the wellbore environment, hydrocarbon production and/or fluid injection treatments.

The coupling assembly of some embodiments of the present techniques may be used with any type of well tool, including packers and sand control devices. The coupling assembly of the present techniques may also be used in combination with other well technologies such as smart well devices, cross-coupling flow techniques, and in-flow control devices. Some embodiments of the coupling assembly of the present techniques may provide a concentric alternate flow path and a simplified coupling interface for use with a variety of well tools. The coupling assembly may also form a manifold region and may connect with a second well tool via a single threaded connection. Further, some embodiments of the coupling assembly may be used in combination with techniques to provide intermittent gravel packing and zonal isolation. Some of these techniques are taught in U.S. Patent Publication No. 2009/0294128 and 2010/0032158, which are hereby incorporated by reference.

Turning now to the drawings, and referring initially to FIG. 1, an exemplary production system 100 in accordance with certain aspects of the present techniques is illustrated. In the exemplary production system 100, a floating production facility 102 is coupled to a subsea tree 104 located on the sea floor 106. Through this subsea tree 104, the floating production facility 102 accesses one or more subsurface formations, such as subsurface formation 107, which may include multiple production intervals or zones 108*a*-108*n*, wherein number "n" is any integer number, having hydrocarbons, such as oil and gas. Beneficially, well tools, such as sand control devices 138*a*-138*n*, may be utilized to enhance the production of hydrocarbons from the production intervals 108*a*-108*n*. However, it should be noted that the production system 100 is illustrated for exemplary purposes and the present techniques may be useful in the production or injection of fluids from any subsea, platform or land location.

The floating production facility 102 may be configured to monitor and produce hydrocarbons from the production intervals 108*a*-108*n* of the subsurface formation 107. The floating production facility 102 may be a floating vessel capable of managing the production of fluids, such as hydrocarbons, from subsea wells. These fluids may be stored on the floating production facility 102 and/or provided to tankers (not shown). To access the production intervals 108*a*-108*n*, the floating production facility 102 is coupled to a subsea tree 104 and control valve 110 via a control umbilical 112. The control umbilical 112 may be operatively connected to production tubing for providing hydrocarbons from the subsea tree 104 to the floating production facility 102, control tubing for hydraulic or electrical devices, and a control cable for communicating with other devices within the wellbore 114.

To access the production intervals 108*a*-108*n*, the wellbore 114 penetrates the sea floor 106 to a depth that interfaces with the production intervals 108*a*-108*n* at different depths within the wellbore 114. As may be appreciated, the production intervals 108*a*-108*n*, which may be referred to as production intervals 108, may include various layers or intervals of rock that may or may not include hydrocarbons and may be referred to as zones. The subsea tree 104, which is positioned over the wellbore 114 at the sea floor 106, provides an interface between devices within the wellbore 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the wellbore 114, the production system 100 may also include different equipment to provide access to the production intervals 108*a*-108*n*. For instance, a surface casing string 124 may be installed from the sea floor 106 to a location at a specific depth beneath the sea floor 106. Within the surface casing string 124, an intermediate or production casing string 126, which may extend down to a depth near the production interval 108, may be utilized to provide support for walls of the wellbore 114. The surface and production casing strings 124 and 126 may be cemented into a fixed position within the wellbore 114 to further stabilize the wellbore 114. Within the surface and production casing strings 124 and 126, a production tubing string 128 may be utilized to provide a flow path through the wellbore 114 for hydrocarbons and other fluids. Along this flow path, a subsurface safety valve 132 may be utilized to block the flow of fluids from the production tubing string 128 in the event of rupture or break above the subsurface safety valve 132. Further, sand control devices 138*a*-138*n* are utilized to manage the flow of particles into the production tubing string 128 with gravel packs 140*a*-140*n*. The sand control devices 138*a*-138*n* may include slotted liners, stand-alone screens (SAS); pre-packed screens; wire-wrapped screens, sintered metal screens, membrane screens, expandable screens and/or wire-mesh screens, while the gravel packs 140*a*-140*n* may include gravel, sand, incompressible particles, or other suitable solid, granular material. Some embodiments of the joint assembly of the present techniques may include a well tool such as one of the sand control devices 138*a*-138*n* or one of the packers 134*a*-134*n*.

The sand control devices 138*a*-138*n* may be coupled to one or more of the packers 134*a*-134*n*, which may be herein referred to as packer(s) 134 or other well tools. Preferably, the coupling assembly between the sand control devices 138*a*-138*n*, which may be herein referred to as sand control device (s) 138, and other well tools should be easy to assemble on the floating production facility 102. Further, the sand control devices 138 may be configured to provide a relatively uninterrupted fluid flow path through a basepipe and a secondary flow path, such as a shunt tube or double-walled pipe.

The system may utilize a packer 134 to isolate specific zones within the wellbore annulus from each other. The joint assemblies may include a packer 134, a sand control device 138 or other well tool and may be configured to provide fluid communication paths between various well tools in different intervals 108*a*-108*n*, while preventing fluid flow in one or more other areas, such as a wellbore annulus. The fluid communication paths may include a common manifold region. Regardless, the packers 134 may be utilized to provide zonal isolation and a mechanism for providing a substantially complete gravel pack within each interval 108*a*-108*n*. For exemplary purposes, certain embodiments of the packers 134 are described further in U.S. Patent Publication No. 2009/0294128 and 2010/0032158 the portions of which describing packers are herein incorporated by reference.

Figure 2A:
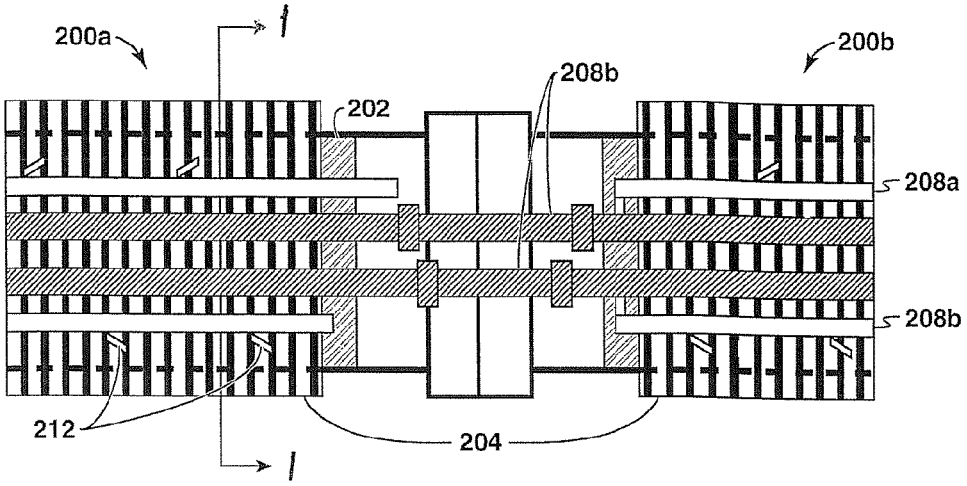
FIGS. 2A-2B are exemplary embodiments of conventional sand control devices utilized within wellbores.
Figure 2B:
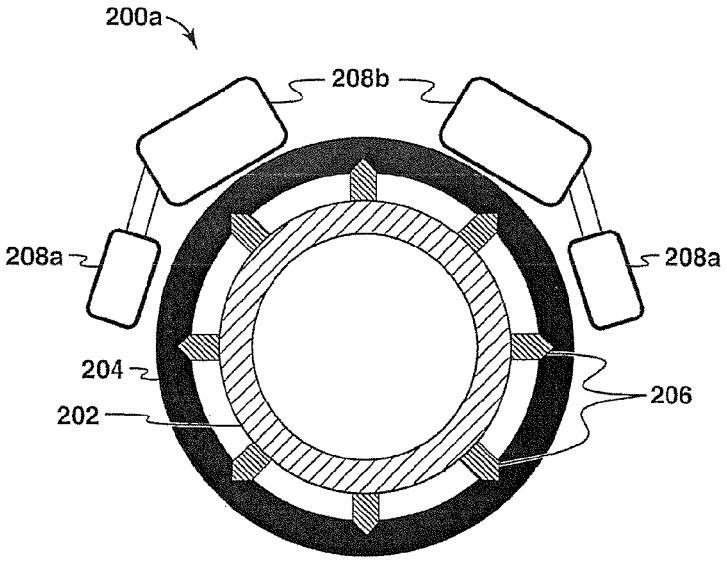

FIGS. 2A-2B are partial views of embodiments of conventional sand control devices jointed together within a wellbore. Each of the sand control devices 200*a* and 200*b* may include a tubular member or base pipe 202 surrounded by a filter medium or sand screen 204. Ribs 206 may be utilized to keep the sand screens 204 a specific distance from the base pipes 202. Sand screens may include multiple wire segments, mesh screen, wire wrapping, a medium to prevent a predetermined particle size and any combination thereof. Shunt tubes 208*a* and 208*b*, which may be collectively referred to as shunt tubes 208, may include packing tubes 208*a* or transport tubes 208*b* and may also be utilized with the sand screens 204 for gravel packing within the wellbore. The packing tubes 208*a* may have one or more valves or nozzles 212 that provide a flow path for the gravel pack slurry, which includes a carrier fluid and gravel, to the annulus formed between the sand screen 204 and the walls of the wellbore. The valves may prevent fluids from an isolated interval from flowing through the at least one jumper tube to another interval. For an alternative perspective of the partial view of the sand control device 200*a*, a cross sectional view of the various components along the line I-I is shown in FIG. 2B. It should be noted that in addition to the external shunt tubes shown in FIGS. 2A and 2B, which are described in U.S. Pat. Nos. 4,945,991 and 5,113,935, internal shunt tubes, which are described in U.S. Pat. Nos. 5,515,915 and 6,227,303, may also be utilized.

While this type of sand control device is useful for certain wells, it is unable to isolate different intervals within the wellbore. As noted above, the problems with the water/gas production may include productivity loss, equipment damage, and/or increased treating, handling and disposal costs. These problems are further compounded for wells that have a number of different completion intervals and where the formation strength may vary from interval to interval. As such, water or gas breakthrough in any one of the intervals may threaten the remaining reserves within the well. The connection of the present technique facilitates efficient alternate path fluid flow technology in a production string 128. Some embodiments of the present techniques provide for a single fixed connection between the downstream end of a first well tool and the upstream end of a second well tool. This eliminates the costly and time-consuming practice of aligning shunt tubes or other alternate flow path devices while eliminating the need for eccentric alternate flow paths. Some embodiments of the present techniques also eliminate the need to make timed connections of primary and secondary flow paths. Accordingly, to provide the zonal isolation within the wellbore 114, various embodiments of sand control devices 138, coupling assemblies and methods for coupling the sand control devices 138 to other well tools are discussed below and shown in FIGS. 3-9.

Figure 3A:
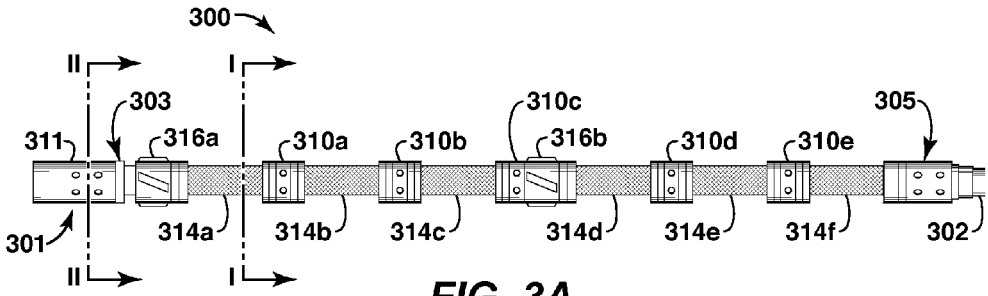
FIGS. 3A-3C are a side view, a section view, and an end view of an exemplary embodiment of a joint assembly utilized in the production system of FIG. 1 in accordance with certain aspects of the present techniques.
Figure 3B:
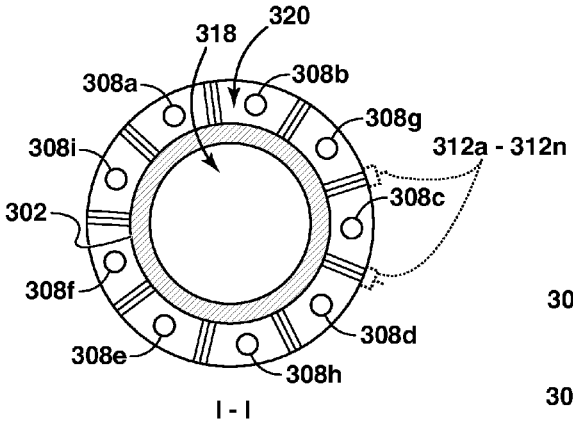
Figure 3C:
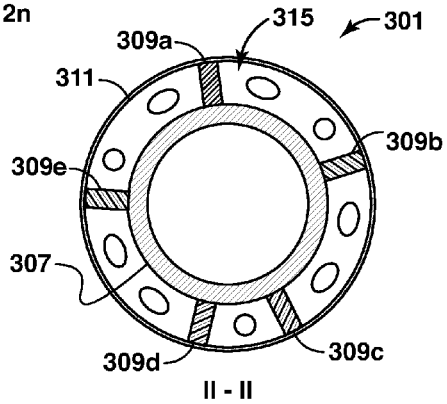

FIGS. 3A-3C are a side view, a sectional view, and an end view of an exemplary embodiment of a joint assembly 300 utilized in the production system 100 of FIG. 1. Accordingly, FIGS. 3A-3C may be best understood by concurrently viewing FIG. 1. The joint assembly 300 may consist of a main body portion having a first or upstream end and a second or downstream end, including a load sleeve assembly 303 operably attached at or near the first end, a torque sleeve assembly 305 operably attached at or near the second end, a coupling assembly 301 operably attached to the first end, the coupling assembly 301 including a coupling 307 and a manifold region 315. Additionally, the load sleeve assembly 303 includes at least one transport conduit and at least one packing conduit (see FIG. 5) and the torque sleeve includes at least one conduit (not shown).

Some embodiments of the joint assembly 300 of the present techniques may be coupled to other joint assemblies, which may include packers, sand control devices, shunted blanks, or other well tools via the coupling assembly 301. It may require only a single threaded connection and be configured to form an adaptable manifold region 315 between the coupled well tools. The manifold region 315 may be configured to form an annulus around the coupling 307. The joint assembly 300 may include a primary fluid flow assembly or path 318 through the main body portion and through an inner diameter of the coupling 307. The load sleeve assembly 303 may include at least one packing conduit and at least one transport conduit, and the torque sleeve assembly 305 may include at least one conduit, but may not include a packing conduit (see FIGS. 5 and 6 for exemplary embodiments of the transport and packing conduits). These conduits may be in fluid flow communication with each other through an alternate fluid flow assembly or path 320 of the joint assembly 300 although the part of the fluid flow assembly 320 in fluid flow communication with the packing conduits of the load sleeve assembly 303 may terminate before entering the torque sleeve assembly, or may terminate inside the torque sleeve assembly 305. The manifold section 315 may facilitate a continuous fluid flow through the alternate fluid flow assembly or path 320 of the joint assembly 300 without requiring a timed connection to line-up the openings of the load sleeve assembly 303 and torque sleeve assembly 305 with the alternate fluid flow assembly 320 during make-up of the production tubing string 128. A single threaded connection makes up the coupling assembly 301 between joint assemblies 300, thereby reducing complexity and make-up time. This technology facilitates alternate path flow through various well tools and allows an operator to design and operate a production tubing string 128 to provide zonal isolation in a wellbore 114 as disclosed in U.S. Patent Publication No. 2009/0294128 and 2010/0032158. The present technology may also be combined with methods and tools for use in installing an open-hole gravel pack completion as disclosed in U.S. Patent Publication No. 2007/0068675, which is hereby incorporated by reference, and other wellbore treatments and processes.

Some embodiments of the joint assembly of the present techniques comprise a load sleeve assembly 303 at a first end, a torque sleeve assembly 305 at a second end, a basepipe 302 forming at least a portion of the main body portion, a coupling 307, a primary flow path 320 through the coupling 307, a coax sleeve 311, and an alternate flow path 320 between the coupling 307 and coax sleeve 311, through the load sleeve assembly 303, along the outer diameter of the basepipe 302, and through the torque sleeve assembly 305. The torque sleeve assembly 305 of one joint assembly 300 is configured to attach to the load sleeve assembly 303 of a second assembly through the coupling assembly 301, whether the joint assembly 300 includes a sand control device, packer, or other well tool.

Some embodiments of the joint assembly 300 preferably include a basepipe 302 having a load sleeve assembly 303 positioned near an upstream or first end of the basepipe 302. The basepipe 302 may include perforations or slots, wherein the perforations or slots may be grouped together along the basepipe 302 or a portion thereof to provide for routing of fluid or other applications. The basepipe 302 preferably extends the axial length of the joint assembly and is operably attached to a torque sleeve 305 at a downstream or second end of the basepipe 302. The joint assembly 300 may further include at least one nozzle ring 310*a*-310*e* positioned along its length, at least one sand screen segment 314*a*-314*f* and at least one centralizer 316*a*-316*b*. As used herein, the term "sand screen" refers to any filtering mechanism configured to prevent passage of particulate matter having a certain size, while permitting flow of gases, liquids and small particles. The size of the filter will generally be in the range of 60-120 mesh, but may be larger or smaller depending on the specific environment. Many sand screen types are known in the art and include wire-wrap, mesh material, woven mesh, sintered mesh, wrap-around perforated or slotted sheets, Schlumberger's MESHRITE™ and Reslink's LINESLOT™ products. Preferably, sand screen segments 314*a*-314*f* are disposed between one of the plurality of nozzle rings 310*a*-310*e* and the torque sleeve assembly 305, between two of the plurality of nozzle rings 310*a*-310*e*, or between the load sleeve assembly 303 and one of the plurality of nozzle rings 310*a*-310*e*. The at least one centralizer 316*a*-316*b* may be placed around at least a portion of the load ring assembly 303 or at least a portion of one of the plurality of nozzle rings 310*a*-310*e*.

As shown in FIG. 3B, in some embodiments of the present techniques, the transport and packing tubes 308*a*-308*i*, (although nine tubes are shown, the invention may include more or less than nine tubes) preferably have a circular cross-section for withstanding higher pressures associated with greater depth wells. The transport and packing tubes 308*a*-308*i* may also be continuous for the entire length of the joint assembly 300. Further, the tubes 308*a*-308*i* may preferably be constructed from steel, more preferably from lower yield, weldable steel. One example is 316L. One embodiment of the load sleeve assembly 303 is constructed from high yield steel, a less weldable material. One preferred embodiment of the load sleeve assembly 303 combines a high strength material with a more weldable material prior to machining. Such a combination may be welded and heat treated. The packing tubes 308*g*-308*i* (although only three packing tubes are shown, the invention may include more or less than three packing tubes) include nozzle openings 310 at regular intervals, for example, every approximately six feet, to facilitate the passage of flowable substances, such as a gravel slurry, from the packing tube 308*g*-308*i* to the wellbore 114 annulus to pack the production interval 108*a*-108*n*, deliver a treatment fluid to the interval, produce hydrocarbons, monitor or manage the wellbore. Many combinations of packing and transport tubes 308*a*-308*i* may be used. An exemplary combination includes six transport tubes 308*a*-308*f* and three packing tubes 308*g*-308*i*.

The preferred embodiment of the joint assembly 300 may further include a plurality of axial rods 312*a*-312*n*, wherein 'n' can be any integer, extending parallel to the shunt tubes 308*a*-308*n* adjacent to the length of the basepipe 302. The axial rods 312*a*-312*n* provide additional structural integrity to the joint assembly 300 and at least partially support the sand screen segments 314*a*-314*f*. Some embodiments of the joint assembly 300 may incorporate from one to six axial rods 312*a*-312*n* per shunt tube 308*a*-308*n*. An exemplary combination includes three axial rods 312 between each pair of shunt tubes 308.

In some embodiments of the present techniques the sand screen segments 314*a*-314*f* may be attached to a weld ring (not shown) where the sand screen segment 314*a*-314*f* meets a load sleeve assembly 303, nozzle ring 310, or torque sleeve assembly 305. An exemplary weld ring includes two pieces joined along at least one axial length by a hinge and joined at an opposite axial length by a split, clip, other attachment mechanism, or some combination. Further, a centralizer 316 may be fitted over the body portion (not shown) of the load sleeve assembly 303 and at the approximate midpoint of the joint assembly 300. In one preferred embodiment, one of the nozzle rings 310*a*-310*e* comprises an extended axial length to accept a centralizer 316 thereon. As shown in FIG. 3C, the manifold region 315 may also include a plurality of torque spacers or profiles 309*a*-309*e*.

Figure 4A:
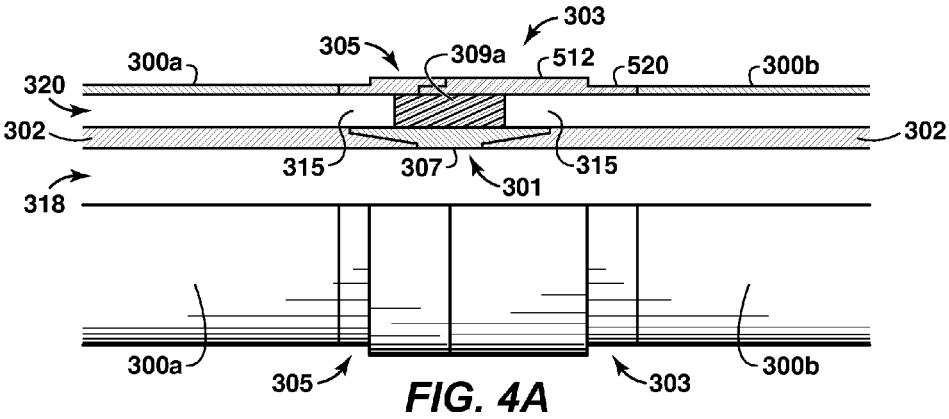
FIGS. 4A-4B are two cut-out side views of exemplary embodiments of the coupling assembly utilized with the joint assembly of FIGS. 3A-3C and the production system of FIG. 1 in accordance with certain aspects of the present techniques.
Figure 4B:
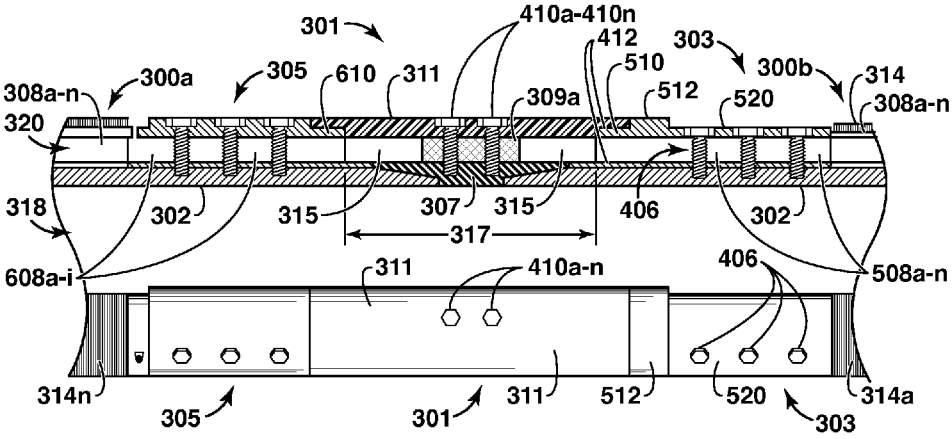

FIGS. 4A-4B are cut-out views of two exemplary embodiments of a coupled assembly 301 utilized in combination with the joint assembly 300 of FIGS. 3A-3B and in the production system 100 of FIG. 1. Accordingly, FIGS. 4A-4B may be best understood by concurrently viewing FIGS. 1 and 3A-3B. In the exemplary embodiment illustrated in FIG. 4A, the coupled assembly 301 includes a first well tool 300*a*, a second well tool 300*b*, a coupling 307, and a torque spacer 309*a*. In the exemplary embodiment illustrated in FIG. 4B, the coupled assembly 301 consists of a first well tool 300*a*, a second well tool 300*b*, a coax sleeve 311, a coupling 307, and at least one torque spacer 309*a*, (although only one is shown in this view, there may be more than one as shown in FIG. 3C), whereby the portion of the coupled assembly 301 including coaxial sleeve 311 and within the region defined by dimension 317 may also be referred to as a coupling assembly 301 for purposes herein.

Referring to FIG. 4A, one preferred embodiment of the coupling assembly 301 may comprise a first joint assembly 300*a* having a main body portion, a primary fluid flow path 318 and an alternate fluid flow path 320, wherein one end of the well tool 300*a* or 300*b* is operably attached to a coupling 307. The embodiment may also include a second well tool 300*b* having primary 318 and alternate 320 fluid flow paths wherein one end of the well tool 300 is operably attached to a coupling 307. Preferably, the primary fluid flow path 318 of the first and second well tools 300*a* and 300*b* are in substantial fluid flow communication via the inner diameter of the coupling 307 and the alternate fluid flow path 320 of the first and second well tools 300*a* and 300*b* are in substantial fluid flow communication through the manifold region 315 around the outer diameter of the coupling 307. This embodiment further includes at least one torque spacer 309*a* fixed at least partially in the manifold region 315. The at least one torque spacer 309*a* is configured to prevent tortuous flow and provide additional structural integrity to the coupling assembly 301. The manifold region 315 is an annular volume at least partially interfered with by the at least one torque spacer 309*a*, wherein the inner diameter of the manifold region 315 is defined by the outer diameter of the coupling 307 and the outer diameter of the manifold region 315 may be defined by the well tools 300 or by a sleeve in substantially concentric alignment with the coupling 307, called a coax sleeve 311.

Referring now to FIG. 4B, some embodiments of the coupling assembly 301 of the present techniques may comprise at least one alternate fluid flow path 320 extending from an upstream or first end of the coupling assembly 301, between the coax sleeve 311 and coupling 307 and through a portion of a load sleeve assembly 303. Preferably, the coupling 307 is operably attached to the upstream end of a basepipe 302 by a threaded connection. The coax sleeve 311 is positioned around the coupling 307, forming a manifold region 315. The attachment mechanism may comprise a threaded connector 410 through the coax sleeve 311, through one of the at least one torque profiles or spacers 309*a* and into the coupling 307. There may be two threaded connectors 410*a*-410*n*, wherein 'n' may be any integer, for each torque profile 309*a*-309*e* wherein one of the threaded connectors 410*a*-410*n* extends through the torque profile 309*a*-309*e* and the other terminates in the body of the torque profile 309*a*-309*e*.

In some embodiments of the present techniques, the volume between the coax sleeve 311 and the coupling 307 forms the manifold region 315 of the coupling assembly 301. The manifold region 315 may beneficially provide an alternate path fluid flow connection between a first and second joint assembly 300*a* and 300*b*, which may include a packer, sand control device, or other well tool. In a preferred embodiment, fluids flowing into the manifold region 315, may follow a path of least resistance when entering the second joint assembly 300*b*. The torque profiles or spacers 309*a*-309*e* may be at least partially disposed between the coax sleeve 311 and the coupling 307 and at least partially disposed in the manifold region 315. The coupling 307 may couple the load sleeve assembly 303 of a first joint assembly 300*a* to the torque sleeve assembly 305 of a second well tool 300*b*. Beneficially, this provides a more simplified make-up and improved compatibility between joint assemblies 300*a* and 300*b* which may include a variety of well tools.

It is also preferred that the coupling 307 operably attaches to the basepipe 302 with a threaded connection and the coax sleeve 311 operably attaches to the coupling 307 with threaded connectors. The threaded connectors 410*a*-410*n*, wherein 'n' may be any integer, pass through the torque spacers or profiles 309*a*-309*e*. The torque profiles 309*a*-309*e* preferably have an aerodynamic shape, more preferably based on NACA (National Advisory Committee for Aeronautics) standards. The number of torque profiles 309*a*-309*e* used may vary according to the dimensions of the coupling assembly 301, the type of fluids intended to pass therethrough and other factors. One exemplary embodiment includes five torque spacers 309*a*-309*e* spaced equally around the annulus of the manifold region 315. However, it should be noted that various numbers of torque spacers 309*a*-309*e* and connectors may be utilized to practice the present techniques.

In some embodiments of the present techniques the torque spacers 309*a*-309*e* may be fixed by threaded connectors 410*a*-410*n* extending through the coax sleeve 311 into the torque spacers 309*a*-309*e*. The threaded connectors 410*a*-410*n* may then protrude into machined holes in the coupling 307. As an example, one preferred embodiment may include ten (10) threaded connectors 410*a*-410*e*, wherein two connectors pass into each aerodynamic torque spacer 309*a*-309*e*. Additionally, one of the connectors 410*a*-410*e* may pass through the torque spacer 309*a*-309*e* and the other of the two connectors 410*a*-410*i* may terminate in the body of the torque spacer 309*a*-309*e*. However, other numbers and combinations of threaded connectors may be utilized to practice the present techniques.

Additionally, the torque spacers or profiles 309*a*-309*e* may be positioned such that the more rounded end is oriented in the upstream direction to create the least amount of drag on the fluid passing through the manifold region 315 while at least partially inhibiting the fluid from following a tortuous path. In one preferred embodiment, sealing rings such as o-rings and backup rings 412 may be fitted between the inner lip of the coax sleeve 311 and a lip portion of each of the torque sleeve assembly 305 and the load sleeve assembly 303.

Figure 5A:
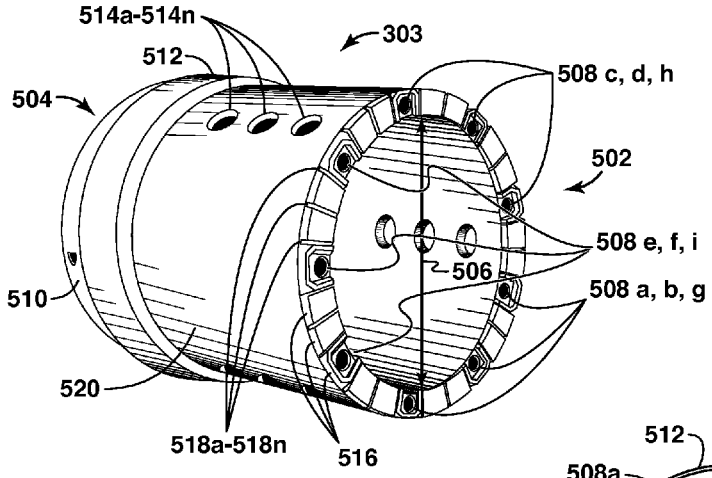
FIGS. 5A-5B are an isometric view and an end view of an exemplary embodiment of a load sleeve assembly utilized as part of the joint assembly of FIGS. 3A-3C, the coupling assembly of FIGS. 4A-4B, and in the production system of FIG. 1 in accordance with certain aspects of the present techniques.
Figure 5B:
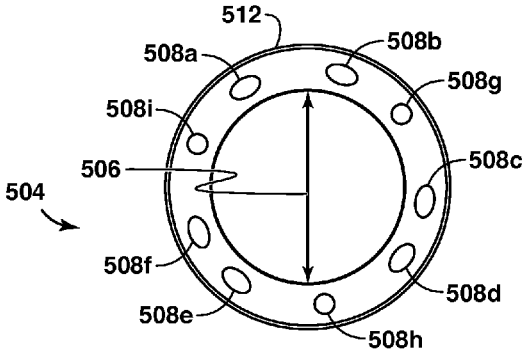

FIGS. 5A-5B are an isometric view and an end view of an exemplary embodiment of a load sleeve assembly 303 utilized in the production system 100 of FIG. 1, the joint assembly 300 of FIGS. 3A-3C, and the coupling assembly 301 of FIGS. 4A-4B in accordance with certain aspects of the present techniques. Accordingly, FIGS. 5A-5B may be best understood by concurrently viewing FIGS. 1, 3A-3C, and 4A-4B. The load sleeve assembly 303 comprises an elongated body 520 of substantially cylindrical shape having an outer diameter and a bore extending from a first end 504 to a second end 502. The load sleeve assembly 303 may also include at least one transport conduit 508*a*-508*f* and at least one packing conduit 508*g*-508*i*, (although six transport conduits and three packing conduits are shown, the invention may include more or less such conduits) extending from the first end 504 to the second end 502 to form openings located at least substantially between the inner diameter 506 and the outer diameter wherein the opening of the at least one transport conduit 508*a*-508*f* is configured at the first end to reduce entry pressure loss (not shown).

Some embodiments of the load sleeve assembly of the present techniques may further include at least one opening at the second end 502 of the load sleeve assembly configured to be in fluid communication with a shunt tube 308*a*-308*i*, a double-walled basepipe, or other alternate path fluid flow mechanism. The first end 504 of the load sleeve assembly 303 includes a lip portion 510 adapted and configured to receive a backup ring and/or an o-ring 412. The load sleeve assembly 303 may also include a load shoulder 512 to permit standard well tool insertion equipment on the floating production facility or rig 102 to handle the load sleeve assembly 303 during screen running operations. The load sleeve assembly 303 additionally may include a body portion 520 and a mechanism for operably attaching a basepipe 302 to the load sleeve assembly 303.

In some embodiments of the present techniques, the transport and packing conduits 508*a*-508*i* are adapted at the second end 502 of the load sleeve assembly 303 to be operably attached, preferably welded, to shunt tubes 308*a*-308*i*. The shunt tubes 308*a*-308*i* may be welded by any method known in the art, including direct welding or welding through a bushing. The shunt tubes 308*a*-308*i* preferably have a round cross-section and are positioned around the basepipe 302 at substantially equal intervals to establish a concentric cross-section. The transport conduits 508*a*-508*f* may also have a reduced entry pressure loss or smooth-profile design at their upstream opening to facilitate the fluid flow into the transport tubes 308*a*-308*f*. The smooth profile design preferably comprises a "trumpet" or "smiley face" configuration. As an example, one preferred embodiment may include six transport conduits 508*a*-508*f* and three packing conduits 508*g*-508*i*. However, it should be noted that any number of packing and transport conduits may be utilized to practice the present techniques.

In some embodiments of the load sleeve assembly 303 a load ring (not shown) is utilized in connection with the load sleeve assembly 303. The load ring is fitted to the basepipe 302 adjacent to and on the upstream side of the load sleeve assembly 303. In one preferred embodiment the load sleeve assembly 303 includes at least one transport conduit 508*a*-508*f* and at least one packing conduit 508*g*-508*i*, wherein the inlets of the load ring are configured to be in fluid flow communication with the transport and packing conduits 508*a*-508*i*. As an example, alignment pins or grooves (not shown) may be incorporated to ensure proper alignment of the load ring and load sleeve assembly 303. A portion of the inlets of the load ring are shaped like the mouth of a trumpet to reduce entry pressure loss or provide a smooth-profile. Preferably, the inlets aligned with the transport conduits 508*a*-508*f* incorporate the "trumpet" shape, whereas the inlets aligned with the packing conduits 508*g*-508*i* do not incorporate the "trumpet" shape.

Although the load ring and load sleeve assembly 303 function as a single unit for fluid flow purposes, it may be preferable to utilize two separate parts to allow a basepipe seal to be placed between the basepipe 302 and the load sleeve assembly 303 so the load ring can act as a seal retainer when properly fitted to the basepipe 302. In an alternate embodiment, the load sleeve assembly 303 and load ring comprise a single unit welded in place on the basepipe 302 such that the weld substantially restricts or prevents fluid flow between the load sleeve assembly 303 and the basepipe 302.

In some embodiments of the present techniques, the load sleeve assembly 303 includes beveled edges 516 at the downstream end 502 for easier welding of the shunt tubes 308*a*-308*i* thereto. The preferred embodiment also incorporates a plurality of radial slots or grooves 518*a*-518*n*, in the face of the downstream or second end 502 to accept a plurality of axial rods 312*a*-312*n*, wherein 'n' can be any integer. An exemplary embodiment includes three axial rods 312*a*-312*n* between each pair of shunt tubes 308*a*-308*i* attached to each load sleeve assembly 303. Other embodiments may include none, one, two, or a varying number of axial rods 312*a*-312*n* between each pair of shunt tubes 308*a*-308*i*.

The load sleeve assembly 303 is preferably manufactured from a material having sufficient strength to withstand the contact forces achieved during screen running operations. One preferred material is a high yield alloy material such as S165M. The load sleeve assembly 303 may be operably attached to the basepipe 302 utilizing any mechanism that effectively transfers forces from the load sleeve assembly 303 to the basepipe 302, such as by welding, clamping, latching, or other techniques known in the art. One preferred mechanism for securing the load sleeve assembly 303 to the basepipe 302 is a threaded connector, such as a torque bolt, driven through the load sleeve assembly 303 into the basepipe 302. Preferably, the load sleeve assembly 303 includes radial holes 514*a*-514*n*, wherein 'n' can be any integer, between its downstream end 502 and the load shoulder 512 to receive the threaded connectors 406. For example, there may be nine holes 514*a*-514*i* in three groups of three spaced substantially equally around the outer circumference of the load sleeve assembly 303 to provide the most even distribution of weight transfer from the load sleeve assembly 303 to the basepipe 302. However, it should be noted that any number of holes may be utilized to practice the present techniques.

The load sleeve assembly 303 preferably includes a lip portion 510, a load shoulder 512, and at least one transport and one packing conduit 508*a*-508*i* extending through the axial length of the load sleeve assembly 303 between the inner and outer diameter of the load sleeve assembly 303. The basepipe 302 extends through the load sleeve assembly 303 and at least one alternate fluid flow path 320 extends from at least one of the transport and packing conduits 508*a*-508*n* down the length of the basepipe 302. The basepipe 302 is operably attached to the load sleeve assembly 303 to transfer axial, rotational, or other forces from the load sleeve assembly 303 to the basepipe 302. Nozzle openings 310*a*-310*e* are positioned at regular intervals along the length of the alternate fluid flow path 320 to facilitate a fluid flow connection between the wellbore 114 annulus and the interior of at least a portion of the alternate fluid flow path 320. The alternate fluid flow path 320 terminates at the transport or packing conduit (see FIG. 6) of the torque sleeve assembly 305 and the torque sleeve assembly 305 is fitted over the basepipe 302. A plurality of axial rods 312*a*-312*n* are positioned in the alternate fluid flow path 320 and extend along the length of the basepipe 302. A sand screen 314*a*-314*f*, is positioned around the joint assembly 300 to filter the passage of gravel, sand particles, and/or other debris from the wellbore 114 annulus to the basepipe 302. The sand screen may include slotted liners, stand-alone screens (SAS); pre-packed screens; wire-wrapped screens, sintered metal screens, membrane screens, expandable screens and/or wire-mesh screens.

Referring back to FIG. 4B, in some embodiments of the present techniques, the joint assembly 300 may include a coupling 307 and a coax sleeve 311, wherein the coupling 307 is operably attached (e.g. a threaded connection, welded connection, fastened connection, or other connection type known in the art) to the basepipe 302 and has approximately the same inner diameter as the basepipe 302 to facilitate fluid flow through the coupling assembly 301. The coax sleeve 311 is positioned substantially concentrically around the coupling 307 and operably attached (e.g. a threaded connection, welded connection, fastened connection, or other connection type known in the art) to the coupling 307. The coax sleeve 311 also preferably comprises a first inner lip at its second or downstream end, which mates with the lip portion 510 of the load sleeve assembly 303 to prevent fluid flow between the coax sleeve 311 and the load sleeve assembly 303. However, it is not necessary for loads to be transferred between the load sleeve assembly 303 and the coax sleeve 311.

Figure 6:
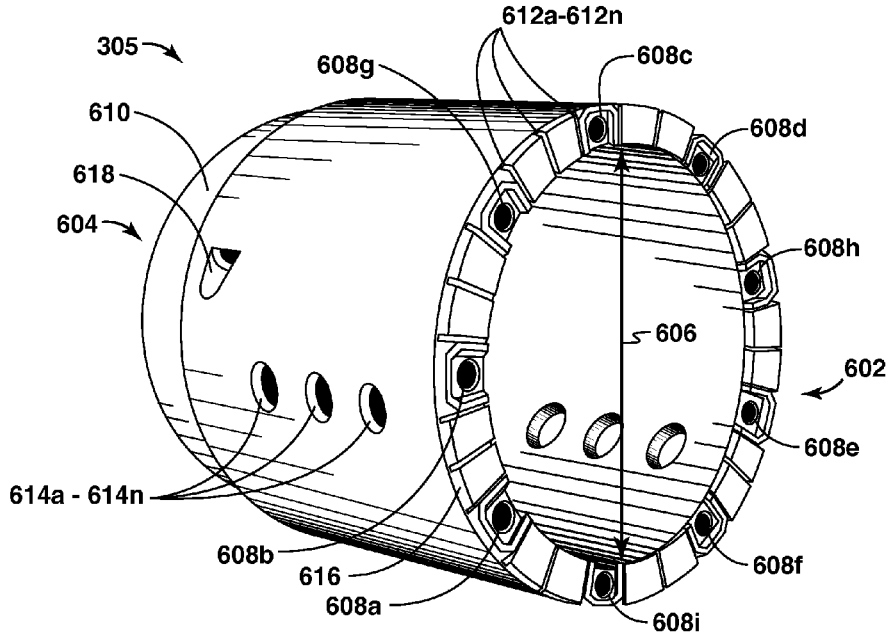
FIG. 6 is an isometric view of an exemplary embodiment of a torque sleeve assembly utilized as part of the joint assembly of FIGS. 3A-3C, the coupling assembly of FIGS. 4A-4B, and in the production system of FIG. 1 in accordance with certain aspects of the present techniques.

FIG. 6 is an isometric view of an exemplary embodiment of a torque sleeve assembly 305 utilized in the production system 100 of FIG. 1, the joint assembly 300 of FIGS. 3A-3C, and the coupling assembly 301 of FIGS. 4A-4B in accordance with certain aspects of the present techniques. Accordingly, FIG. 6 may be best understood by concurrently viewing FIGS. 1, 3A-3C, and 4A-4B. The torque sleeve assembly 305 may be positioned at the downstream or second end of the joint assembly 300 and includes an upstream or first end 602, a downstream or second end 604, an inner diameter 606, at least one transport conduit 608*a*-608*i*, positioned substantially around and outside the inner diameter 606, but substantially within an outside diameter. The at least one transport conduit 608*a*-608*f* extends from the first end 602 to the second end 604, while the at least one packing conduit 608*g*-608*i* may terminate before reaching the second end 604.

In some embodiments, the torque sleeve assembly 305 has beveled edges 616 at the upstream end 602 for easier attachment of the shunt tubes 308 thereto. The preferred embodiment may also incorporate a plurality of radial slots or grooves 612*a*-612*n*, wherein 'n' may be any integer, in the face of the upstream end 602 to accept a plurality of axial rods 312*a*-312*n*, wherein 'n' may be any integer. For example, the torque sleeve may have three axial rods 312*a*-312*c* between each pair of shunt tubes 308*a*-308*i* for a total of 27 axial rods attached to each torque sleeve assembly 305. Other embodiments may include none, one, two, or a varying number of axial rods 312*a*-312*n* between each pair of shunt tubes 308*a*-308*i*.

In some embodiments of the present techniques the torque sleeve assembly 305 may preferably be operably attached to the basepipe 302 utilizing any mechanism that transfers force from one body to the other, such as by welding, clamping, latching, or other means known in the art. One preferred mechanism for completing this connection is a threaded fastener, for example, a torque bolt, through the torque sleeve assembly 305 into the basepipe 302. Preferably, the torque sleeve assembly includes radial holes 614*a*-614*n*, wherein 'n' may be any integer, between the upstream end 602 and the lip portion 610 to accept threaded fasteners therein. For example, there may be nine holes 614*a*-614*i* in three groups of three, spaced equally around the outer circumference of the torque sleeve assembly 305. However, it should be noted that other numbers and configurations of holes 614*a*-614*n* may be utilized to practice the present techniques.

In some embodiments of the present techniques the transport and packing conduits 608*a*-608*i* are adapted at the upstream end 602 of the torque sleeve assembly 305 to be operably attached, preferably welded, to shunt tubes 308*a*-308*i*. The shunt tubes 308*a*-308*i* preferably have a circular cross-section and are positioned around the basepipe 302 at substantially equal intervals to establish a balanced, concentric cross-section of the joint assembly 300. The conduits 608*a*-608*i* are configured to operably attach to the downstream ends of the shunt tubes 308*a*-308*i*, the size and shape of which may vary in accordance with the present teachings. As an example, one preferred embodiment may include six transport conduits 608*a*-608*f* and three packing conduits 608*g*-608*i*. However, it should be noted that any number of packing and transport conduits may be utilized to achieve the benefits of the present techniques.

In some embodiments of the present techniques, the torque sleeve assembly 305 may include only transport conduits 608*a*-608*f* and the packing tubes 308*g*-308*i* may terminate at or before they reach the second end 604 of the torque sleeve assembly 305. In a preferred embodiment, the packing conduits 608*g*-608*i* may terminate in the body of the torque sleeve assembly 305. In this configuration, the packing conduits 608*g*-608*i* may be in fluid communication with the exterior of the torque sleeve assembly 305 via at least one perforation 618. The perforation 618 may be fitted with a nozzle insert and a back flow prevention device (not shown). In operation, this permits a fluid flow, such as a gravel slurry, to exit the packing tube 608*g*-608*i* through the perforation 618, but prevents fluids from flowing back into the packing conduit 608*g*-608*i* through the perforation 618.

In some embodiments, the torque sleeve assembly 305 may further consist of a lip portion 610 and a plurality of fluid flow channels 608*a*-608*i*. When a first and second joint assembly 300*a* and 300*b* (which may include a well tool) of the present techniques are connected, the downstream end of the basepipe 302 of the first joint assembly 300*a* may be operably attached (e.g. a threaded connection, welded connection, fastened connection, or other connection type) to the coupling 307 of the second joint assembly 300*b*. Also, an inner lip of the coax sleeve 311 of the second joint assembly 300*b* mates with the lip portion 610 of the torque sleeve assembly 305 of the first joint assembly 300*a* in such a way as to prevent fluid flow from inside the joint assembly 300 to the wellbore annulus 114 by flowing between the coax sleeve 311 and the torque sleeve assembly 305. However, it is not necessary for loads to be transferred between the torque sleeve assembly 305 and the coax sleeve 311.

Figure 7:
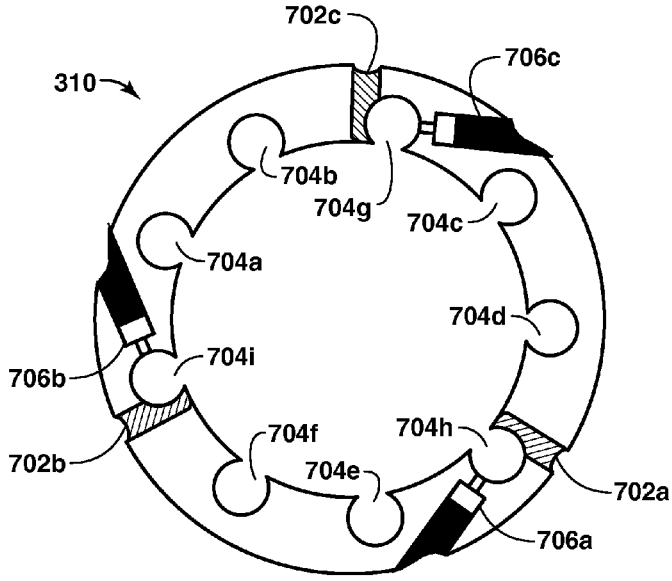
FIG. 7 is an end view of an exemplary embodiment of a nozzle ring utilized in the joint assembly of FIGS. 3A-3C in accordance with certain aspects of the present techniques.

FIG. 7 is an end view of an exemplary embodiment of one of the plurality of nozzle rings 310*a*-310*e* utilized in the production system 100 of FIG. 1 and the joint assembly 300 of FIGS. 3A-3C in accordance with certain aspects of the present techniques. Accordingly, FIG. 7 may be best understood by concurrently viewing FIGS. 1 and 3A-3C. This embodiment refers to any or all of the plurality of nozzle rings 310*a*-310*e*, but will be referred to hereafter as nozzle ring 310. The nozzle ring 310 is adapted and configured to fit around the basepipe 302 and shunt tubes 308*a*-308*i*. Preferably, the nozzle ring 310 includes at least one channel 704*a*-704*i* to accept the at least one shunt tube 308*a*-308*i*. Each channel 704*a*-704*i* extends through the nozzle ring 310 from an upstream or first end to a downstream or second end. For each packing tube 308*g*-308*i*, the nozzle ring 310 includes an opening or hole 702*a*-702*c*. Each hole, 702*a*-702*c* extends from an outer surface of the nozzle ring toward a central point of the nozzle ring 310 in the radial direction. Each hole 702*a*-702*c* interferes with or intersects, at least partially, the at least one channel 704*a*-704*c* such that they are in fluid flow communication. A wedge (not shown) may be inserted into each hole 702*a*-702*c* such that a force is applied against a shunt tube 308*g*-308*i* pressing the shunt tube 308*g*-308*i* against the opposite side of the channel wall. For each channel 704*a*-704*i* having an interfering hole 702*a*-702*c*, there is also an outlet 706*a*-706*c* extending from the channel wall through the nozzle ring 310. The outlet 706*a*-706*c* has a central axis oriented perpendicular to the central axis of the hole 702*a*-702*c*. Each shunt tube 308*g*-308*i* inserted through a channel having a hole 702*a*-702*c* includes a perforation in fluid flow communication with an outlet 706*a*-706*c* and each outlet 706*a*-706*c* preferably includes a nozzle insert (not shown).

Figure 8A:
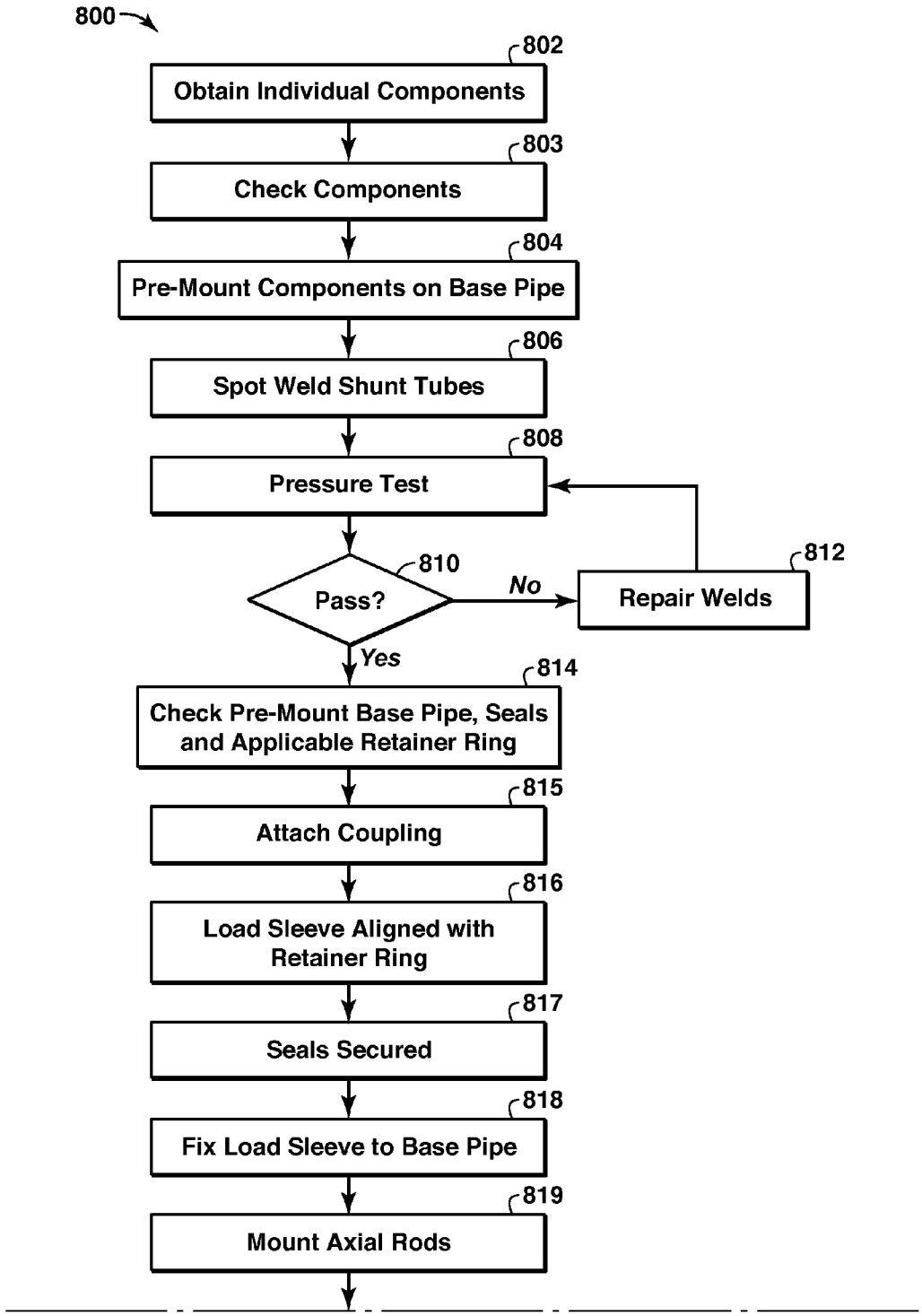
FIGS. 8A-8B are exemplary flow charts of a method of assembly of the joint assembly of FIGS. 3A-3C in accordance with aspects of the present techniques.
Figure 8B:
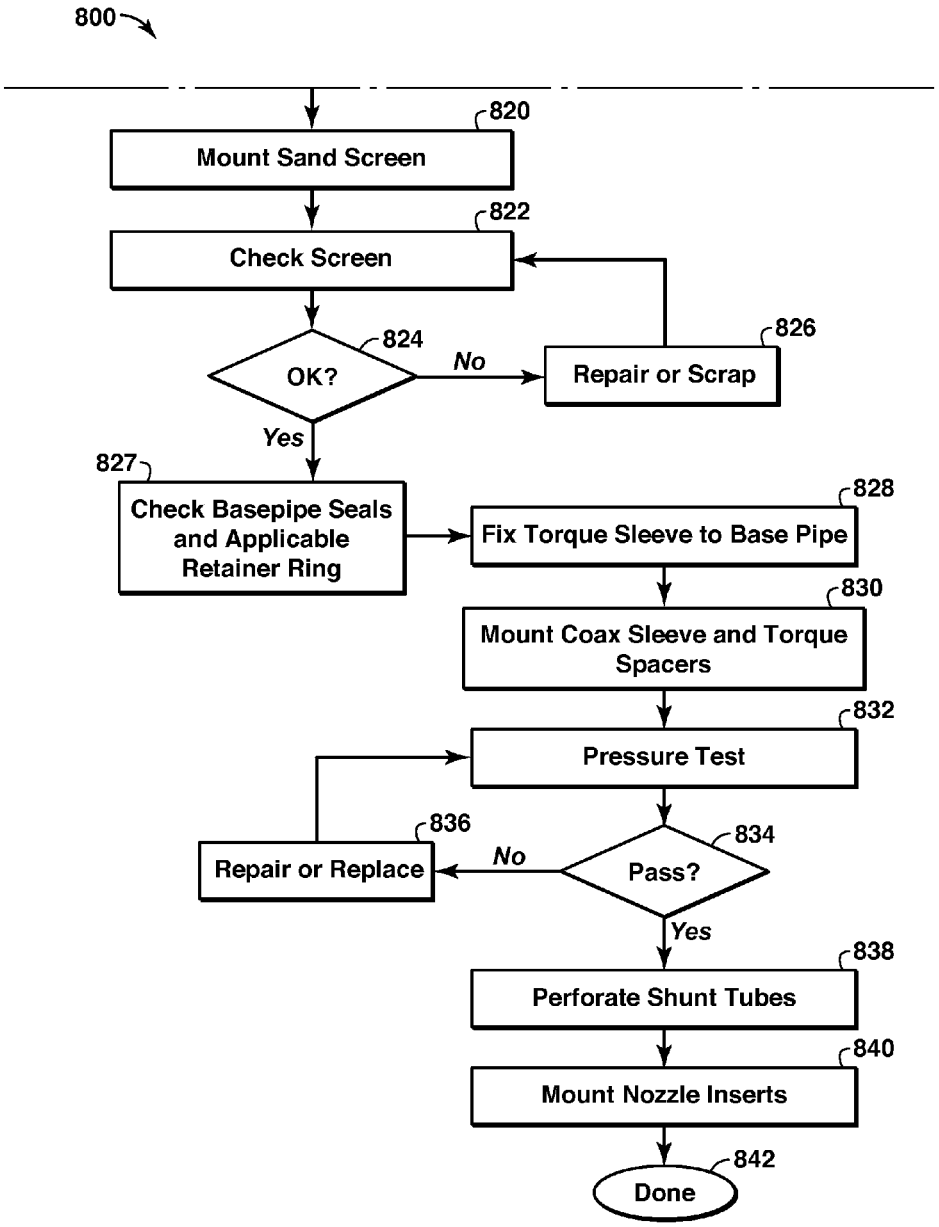

FIGS. 8A-8B are exemplary flow charts of the method of manufacture of the joint assembly 300 of FIGS. 3A-3C, which includes the coupling assembly 301 of FIGS. 4A-4B, the load sleeve assembly 303 of FIGS. 5A-5B and the torque sleeve assembly 305 of FIG. 6, and is utilized in the production system 100 of FIG. 1, in accordance with aspects of the present techniques. Accordingly, the flow chart 800, may be best understood by concurrently viewing FIGS. 1, 3A-3C, 4A-4B, 5A-5B, and 6. It should be understood that the steps of the exemplary embodiment can be accomplished in any order, unless otherwise specified. The method comprises operably attaching a load sleeve assembly 303 having transport and packing conduits 508*a*-508*i* to the main body portion of the joint assembly 300 at or near the first end thereof, operably attaching a torque sleeve assembly 305 having at least one conduit 608*a*-608*i* to the main body portion of the joint assembly 300 at or near the second end thereof, and operably attaching a coupling assembly 301 to at least a portion of the first end of the main body portion of the joint assembly 300, wherein the coupling assembly 301 includes a manifold region 315 in fluid flow communication with the packing and transport conduits 508*a*-508*i* of the load sleeve assembly 303 and the at least one conduit 608*a*-608*i* of the torque sleeve assembly 305.

In some embodiments of the present techniques, the individual components are provided 802 and pre-mounted on or around 804 the basepipe 302. The coupling 307 is attached 816 and the seals are mounted 817. The load sleeve assembly 303 is fixed 818 to the basepipe 302 and the sand screen segments 314*a*-314*n* are mounted. The torque sleeve assembly 305 is fixed 828 to the basepipe 302, the coupling assembly 301 is assembled 830, and the nozzle openings 310*a*-310*e* are completed 838. The torque sleeve assembly may have transport conduits 608*a*-608*f*, but may or may not have packing conduits 608*g*-608*i*.

In a preferred method of manufacturing the joint assembly 300, the seal surfaces and threads at each end of the basepipe 302 are inspected for scratches, marks, or dents before assembly 803. Then the load sleeve assembly 303, torque sleeve assembly 305, nozzle rings 310*a*-310*e*, centralizers 316*a*-316*d*, and weld rings (not shown) are positioned 804 onto the basepipe 302, preferably by sliding. Note that the shunt tubes 308*a*-308*i* are fitted to the load sleeve assembly 303 at the upstream or first end of the basepipe 302 and the torque sleeve assembly 305 at the downstream or second end of the basepipe 302. Once these parts are in place, the shunt tubes 308*a*-308*i* are tack or spot welded 806 to each of the load sleeve assembly 303 and the torque sleeve assembly 305. A non-destructive pressure test is performed 808 and if the assembly passes 810, the manufacturing process continues. If the assembly fails, the welds that failed are repaired 812 and retested 808.

Once the welds have passed the pressure test, the basepipe 302 is positioned to expose an upstream end and the upstream end is prepared for mounting 814 by cleaning, greasing, and other appropriate preparation techniques known in the art. Next, the sealing devices, such as back-up rings and o-rings, may be slid 814 onto the basepipe 302. Then, the load ring may be positioned over the basepipe 302 such that it retains the position of the sealing devices 814. Once the load ring is in place, the coupling 307 may be threaded 815 onto the upstream end of the basepipe 302 and guide pins (not shown) are inserted into the upstream end of the load sleeve assembly 303, aligning the load ring therewith 816. The manufacturer may then slide the load sleeve assembly 303 (including the rest of the assembly) over the backup ring and o-ring seals 817 such that the load sleeve 303 is against the load ring, which is against the coupling 307. The manufacturer may then drill holes into the basepipe 302 through the apertures 514*a*-514*n*, wherein 'n' may be any integer, of the load sleeve assembly 303 and mount torque bolts 818 to secure the load sleeve assembly 303 to the basepipe 302. Then, axial rods 312*a*-312*n* may be aligned parallel with the shunt tubes 308*a*-308*i* and welded 819 into pre-formed slots in the downstream end of the load sleeve assembly 303.

Once the axial rods 312*a*-312*n* are properly secured, screen sections 314*a*-314*f* may be mounted 820 utilizing a sand screen such as ResLink's LINESLO™ wire wrap sand screen. The sand screen will extend from the load sleeve assembly 303 to the first nozzle ring 310*a*, then from the first nozzle ring 310*a* to the second nozzle ring 310*b*, the second nozzle ring 310*b* to the centralizer 316*a* and the third nozzle ring 310*c*, and so on to the torque sleeve assembly 305 until the shunt tubes 308*a*-308*i* are substantially enclosed along the length of the joint assembly 300. The weld rings may then be welded into place so as to hold the sand screens 314*a*-314*f* in place. The manufacturer may check the screen to ensure proper mounting and configuration 822. If a wire wrap screen is used, the slot opening size may be checked, but this step can be accomplished prior to welding the weld rings. If the sand screens 314*a*-314*f* check out 824, then the process continues, otherwise, the screens are repaired or the joint assembly 300 is scrapped 826. The downstream end of basepipe 302 is prepared for mounting 827 by cleaning, greasing, and other appropriate preparation techniques known in the art. Next, the sealing devices, such as back-up rings and o-rings, may be slid onto the basepipe 302. Then the torque sleeve assembly 305 may be fixedly attached 828 to the basepipe 302 in a similar manner to the load sleeve assembly 303. Once the torque sleeve assembly 305 is attached, the sealing devices may be installed between the basepipe 302 and torque sleeve assembly 305 and a seal retainer (not shown) may be mounted and tack welded into place. Note that the steps of fixing the torque sleeve assembly 305 and installing the seals may be conducted before the axial rods 312 are welded into place 819.

The coax sleeve 311 may be installed 830 at this juncture, although these steps may be accomplished at any time after the load sleeve assembly 303 is fixed to the basepipe 302. The o-rings and backup rings (not shown) are inserted into an inner lip portion of the coax sleeve 311 at each end of the coax sleeve 311 and torque spacers 309*a*-309*e* are mounted to an inside surface of the coax sleeve 311 utilizing short socket head screws with the butt end of the torque spacers 309*a*-309*e* pointing toward the upstream end of the joint assembly 300. Then the manufacturer may slide the coax sleeve 311 over the coupling 307 and replace the socket head screws with torque bolts 410 having o-rings, wherein at least a portion of the torque bolts 410 extend through the coax sleeve 311, the torque spacer 309*a*-309*e*, and into the coupling 307. However, in one preferred embodiment, a portion of the torque bolts 410 terminate in the torque spacer 309*a*-309*e* and others extend through the torque spacer 309*a*-309*e* into the coupling 307.

Any time after the sand screens 314*a*-314*f* are installed, the manufacturer may prepare the nozzle rings 310*a*-310*e*. For each packing shunt tube 308*g*-308*i*, a wedge (not shown) is inserted into each hole 702*a*-702*c* located around the outer diameter of the nozzle ring 310*a*-310*e* generating a force against each packing shunt tube 308*g*-308*i*. Then, the wedge is welded into place. A pressure test may be conducted 832 and, if passed 834, the packing shunt tubes 308*g*-308*i* are perforated 838 by drilling into the tube through an outlet 706*a*-706*c*. If pressure test 832 is not passed, a defect may be determined and then repaired or replaced 836 such that the apparatus may be retested 832. In one exemplary embodiment, a 20 mm tube may be perforated by a 8 mm drill bit. Then a nozzle insert and a nozzle insert housing (not shown) are installed 840 into each outlet 706*a*-706*c* and the fabrication is complete 842. Before shipment, the sand screen is properly packaged and the process is complete.

Figure 9:
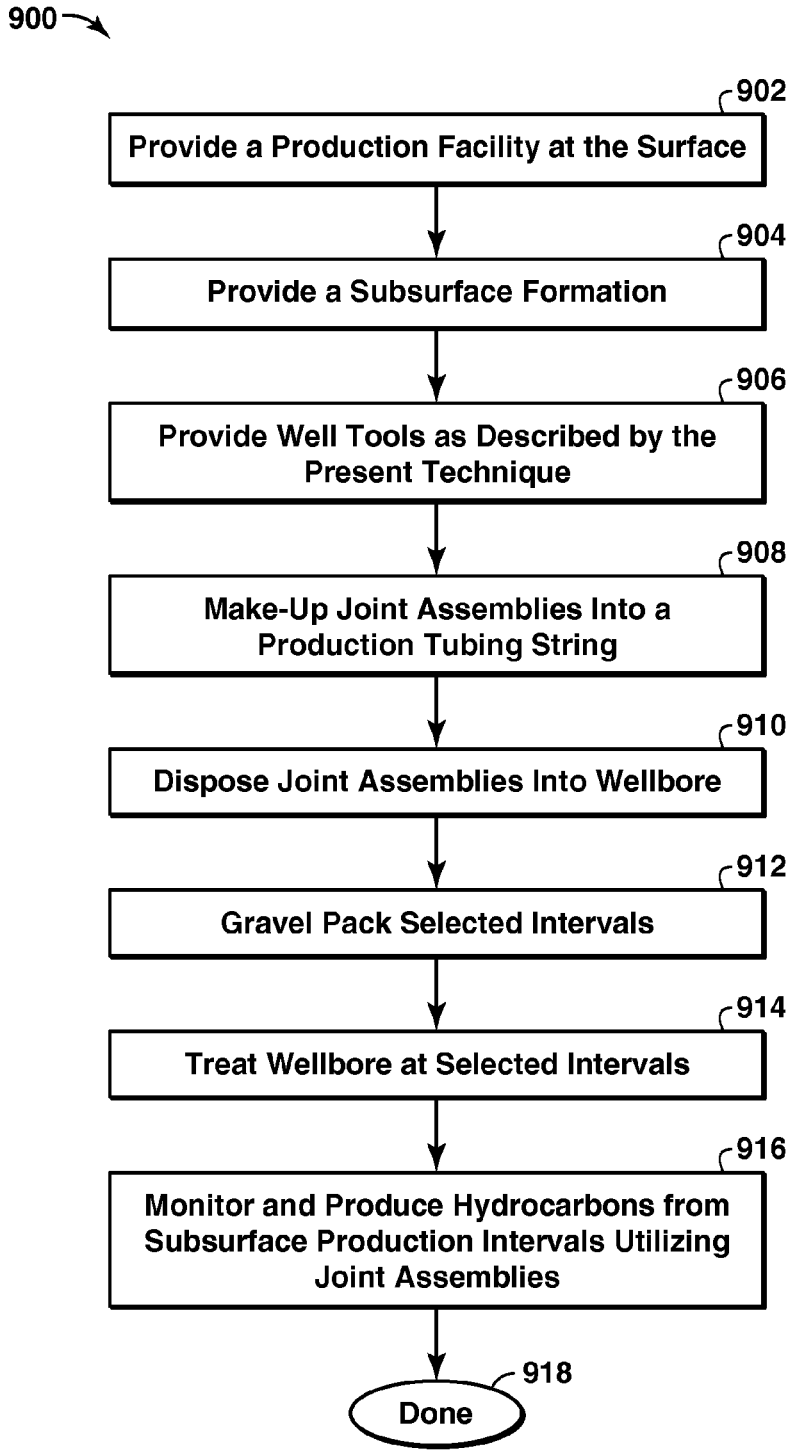
FIG. 9 is an exemplary flow chart of a method of producing hydrocarbons from a subterranean formation utilizing the joint assembly of FIGS. 3A-3C and the production system of FIG. 1 in accordance with aspects of the present techniques.

FIG. 9 is an exemplary flow chart of the method of producing hydrocarbons utilizing the production system 100 of FIG. 1 and the joint assembly 300 of FIG. 3A-3C, in accordance with aspects of the present techniques. Accordingly, this flow chart, which is referred to by reference numeral 900, may be best understood by concurrently viewing FIGS. 1 and 3A-3C. The process generally comprises providing a production facility at a surface location 902, providing a subsurface formation 904, and providing well tools such as described in the exemplary techniques 906, and making up 908 a plurality of joint assemblies 300 into a production tubing string in accordance with the present techniques as disclosed herein, disposing the string into a wellbore 910 at a productive interval and producing hydrocarbons 916 through the production tubing string to complete the exemplary process 918.

In a preferred embodiment, an operator may utilize the coupling assembly 301 and joint assembly 300 in combination with a variety of well tools such as a packer 134, a sand control device 138, or a shunted blank. The operator may gravel pack 912 a formation or apply a fluid treatment 914 to a formation using any variety of packing techniques known in the art, such as those described in U.S. Provisional Application Nos. 60/765,023 and 60/775,434. Although the present techniques may be utilized with alternate path techniques, they are not limited to such methods of packing, treating or producing hydrocarbons from subterranean formations.

It should also be noted that the coupling mechanism for these packers and sand control devices may include sealing mechanisms as described in U.S. Pat. No. 6,464,261; U.S. Pat. No. 6,814,144; U.S. Patent Application Pub. No. 2004/0140089; U.S. Patent Application Pub. No. 2005/0061501; U.S. Patent Application Pub. No. 2005/0082060; and U.S. Patent Application Pub. No. 2005/0028977.

In addition, it should be noted that the shunt tubes utilized in the above embodiments may have various geometries. The selection of shunt tube shape relies on space limitations, pressure loss, and burst/collapse capacity. For instance, the shunt tubes may be circular, rectangular, trapezoidal, polygons, or other shapes for different applications. One example of a shunt tube is ExxonMobil's AIIPAC® and AIIFRAC®. Moreover, it should be appreciated that the present techniques may also be utilized for gas breakthroughs as well.

While the present techniques of the invention may be susceptible to various modifications and alternate forms, the exemplary embodiments discussed above have been shown only by way of example. However, it should again be understood that the invention is not intended to be limited to the particular embodiments disclosed herein. Indeed, the present techniques of the invention include all alternatives, modifications, and equivalents falling within the true spirit and scope of the invention as defined by the following appended claims.

What we claim is:

1. A nozzle ring comprising:

a body of substantially cylindrical shape having an outer diameter and a bore extending from a first end to a second end, the bore forming an inner diameter;

at least one transport channel and at least one packing channel, the at least one transport channel and at least one packing channel extending from the first end to the second end and located substantially between the inner diameter and outer diameter, wherein each of the transport channel and packing channel are configured to receive a shunt tube therein;

a fluid outlet aperture formed in the outer diameter of the body and extending radially inward, wherein the aperture at least partially intersects at least one of the at least one packing channel and the aperture intersects the shunt tube received in the at least one packing channel such that the shunt tube in the at least one packing channel and the fluid outlet aperture are in fluid flow communication when the shunt tube has a shunt tube fluid outlet positioned within the packing channel; and at least one anchor port formed from the at least one packing channel to the outer diameter for receiving an anchor that engages the shunt tube to maintain fluid flow between the engaged shunt tube fluid outlet and the fluid outlet aperture.

2. The nozzle ring of claim 1, the at least one anchor port having a central axis; and the fluid outlet aperture having a central axis, wherein the central axis of the anchor port is oriented substantially perpendicular to the central axis of the fluid outlet aperture.

3. The nozzle ring of claim 2 wherein a shunt tube is positioned through each of the at least one transport channel and the at least one packing channel.

4. The nozzle ring of claim 3 wherein each shunt tube disposed through a packing channel comprises a perforation as the shunt tube fluid outlet, wherein the fluid outlet aperture and the perforation are in substantial alignment to enable fluid flow there between.

5. The nozzle ring of claim 4 wherein a shunt tube anchor is disposed in the anchor port such that the anchor contacts the shunt tube to form a force on an outside surface of the shunt tube to maintain the fluid flow between the engaged shunt tube fluid outlet and the fluid outlet aperture.

6. The nozzle ring of claim 5 comprising a nozzle insert, wherein the nozzle insert is fixedly attached in the fluid outlet aperture.

* * * * *